US009169768B2

(12) United States Patent
Kim et al.

(10) Patent No.: US 9,169,768 B2
(45) Date of Patent: Oct. 27, 2015

(54) METHOD AND SYSTEM FOR DIAGNOSING INSUFFICIENCY OF VEHICLE COOLANT

(71) Applicants: Hyundai Motor Company, Seoul (KR); Kia Motors Corporation, Seoul (KR)

(72) Inventors: Seong Min Kim, Changwon-si (KR); Dong Jin Nam, Hwaseong-si (KR); Sang Hwan Kim, Suwon-si (KR); Yong Hyun Kim, Seoul (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 175 days.

(21) Appl. No.: 14/015,588

(22) Filed: Aug. 30, 2013

(65) Prior Publication Data

US 2014/0343821 A1 Nov. 20, 2014

(30) Foreign Application Priority Data

May 15, 2013 (KR) ..... 10-2013-0054727

(51) Int. Cl.

| | |
|---|---|
| ***F01P 11/18*** | (2006.01) |
| ***F01P 7/14*** | (2006.01) |
| ***F01P 5/14*** | (2006.01) |
| ***F01P 7/02*** | (2006.01) |
| ***F01P 7/16*** | (2006.01) |

(52) U.S. Cl.

CPC . *F01P 11/18* (2013.01); *F01P 5/14* (2013.01); *F01P 7/026* (2013.01); *F01P 7/14* (2013.01); *F01P 7/164* (2013.01)

(58) Field of Classification Search

CPC ..... F01P 5/14; F01P 7/164; F01P 7/14; F01P 7/026

USPC ..... 123/41.01, 41.05, 41.44, 41.47; 701/101

See application file for complete search history.

(56) References Cited

U.S. PATENT DOCUMENTS

2004/0011304 A1* 1/2004 Herynek et al. ..... 123/41.1

FOREIGN PATENT DOCUMENTS

| | | | |
|---|---|---|---|
| JP | 2009-030999 | A | 2/2009 |
| JP | 2009-112136 | A | 5/2009 |
| JP | 2009-244184 | A | 10/2009 |
| JP | 2011-089480 | A | 5/2011 |
| JP | 2011-089481 | A | 5/2011 |
| KR | 10-2003-0095741 | A | 12/2003 |
| KR | 10-2005-0044026 | A | 5/2005 |
| KR | 10-2011-0062409 | A | 6/2011 |

* cited by examiner

*Primary Examiner* — Mahmoud Gimie

(74) *Attorney, Agent, or Firm* — McDermott Will & Emory LLP

(57) ABSTRACT

A method and a system for diagnosing insufficiency of vehicle coolant includes a preparing step of checking whether the vehicle is in a stop state and is on flat ground. An operating step applies a predefined output to a coolant water pump when the vehicle is in the stop state and is on flat ground. A measuring step measures a rotation speed of an impeller of the coolant water pump for a period in which the predefined output is applied to the coolant water pump. A M determining step compares the measured rotation speed of the impeller of the coolant water pump with a reference speed to determine whether or not the coolant is insufficient.

6 Claims, 3 Drawing Sheets

METHOD AND SYSTEM FOR DIAGNOSING INSUFFICIENCY OF VEHICLE COOLANT

CROSS REFERENCE TO RELATED APPLICATION

This application claims under 35 U.S.C. §119(a) priority to Korean Patent Application No. 10-2013-0054727 filed on May 15, 2013, the entire contents of which are incorporated herein by reference.

TECHNICAL FIELD

The present disclosure relates to a method and a system for diagnosing insufficiency of a vehicle coolant that is capable of accurately and simply checking an insufficiency phenomenon of a coolant in a vehicle in which an electric water pump is mounted.

BACKGROUND

The present disclosure diagnoses and informs of insufficiency of a coolant through a cooperative control between controllers, without using a separate sensor in a hybrid vehicle, or the like, in which an electric water pump (EWP) is mounted.

In the hybrid vehicle, or the like, temperature is an important factor in normal operation of a power converter component. Excessive heat causing a temperature rise deteriorates vehicle performance, and the vehicle may shut down in severe cases, which may cause a significantly dangerous situation to a driver. Therefore, accurately diagnosing a coolant insufficiency in a power converter cooling system and informing the driver to prevent overheating in a control circuit in advance are critical.

A reliable diagnosis of an insufficiency of a coolant control technology through a cooperative control between controllers based on analysis and evaluation of disturbance factors, such as an input voltage, a control duty, a vehicle deviation, a component deviation, a duration of deterioration, a coolant temperature, a coolant amount, an inclined angle sensor error, and the like of the electric water pump (EWP) of the power converter cooling system can be implemented.

A vehicle using an electric water pump (EWP) according to the related art does not have a function of diagnosing an absence or insufficiency of a coolant, but a method of indirectly diagnosing absence or insufficiency of a coolant by calculating a temperature rise rate using a temperature sensor has been mainly used.

For example, a deviation (gradient) of a temperature change depending on time is larger when there is less coolant when a vehicle switch is turned on. The coolant is assumed to be insufficient when the deviation is excessive compared with temperature change modeling measured when the coolant is sufficient. The driver is then informed about the insufficiency of coolant, thereby preventing a problem associated with insufficiency of the coolant.

The matters described in the Background section are provided only to assist in the understanding for the background of the present disclosure and should not be considered as corresponding to the related art known to those skilled in the art.

SUMMARY

A method and a system for diagnosing insufficiency of vehicle coolant according to the present disclosure maintains a normal control by accurately diagnosing insufficiency of a coolant in a power converter cooling system and informs a driver of the insufficiency of the coolant to prevent overheating in a control circuit.

According to an exemplary embodiment of the present disclosure, a method for diagnosing an insufficiency of vehicle coolant includes a preparing step of checking whether the vehicle is in a stop state and is on flat ground. An operating step applies a predefined output to a coolant water pump when the vehicle is in the stop state and is on flat ground. A measuring step measures rotation speed of a coolant water pump impeller for a period in which the predefined output is applied to the coolant water pump. A determining step compares the measured rotation speed of the coolant water pump impeller with a reference speed to determine whether or not the coolant is insufficient.

The preparing step may further check whether a vehicle speed is 0 and is on flat ground when the vehicle is in a start-up state.

In the case in which the vehicle speed is neither 0 nor is on flat ground when the vehicle is in the start-up state, the preparing step may check again to determine whether the vehicle is stopped when driving and is on the flat ground.

In the operating step, if the vehicle is again stopped when being driven and is on flat ground, the predefined output may be applied to the coolant water pump after a first reference time elapses.

In the determining step, in the case in which the measured rotation speed of the coolant water pump impeller is larger than the reference speed, the coolant may be insufficient.

In the operating step, the predefined output may be applied to the coolant water pump for a second reference time. Rotation speeds of the coolant water pump impeller measured for the second reference time may be averaged and compared with the reference speed to determine whether or not the coolant is insufficient in the determining step.

According to another exemplary embodiment of the present disclosure, a system for diagnosing insufficiency of vehicle coolant includes a vehicle speed sensor, a gradient sensor, and a coolant water pump including an impeller receiving an output from a power supplier to thereby be rotated. A controller performing a feedback-control on the output from the power supplier to the coolant water pump depending on coolant temperature at ordinary times, controls the power supplier to apply a predefined output to the coolant water pump when the vehicle is in a stop state and is on a flat ground, measure a rotation speed of the coolant water pump impeller, and compare the measured rotation speed with a reference speed to determine whether or not the coolant is insufficient.

DETAILED DESCRIPTION

Figure 1:
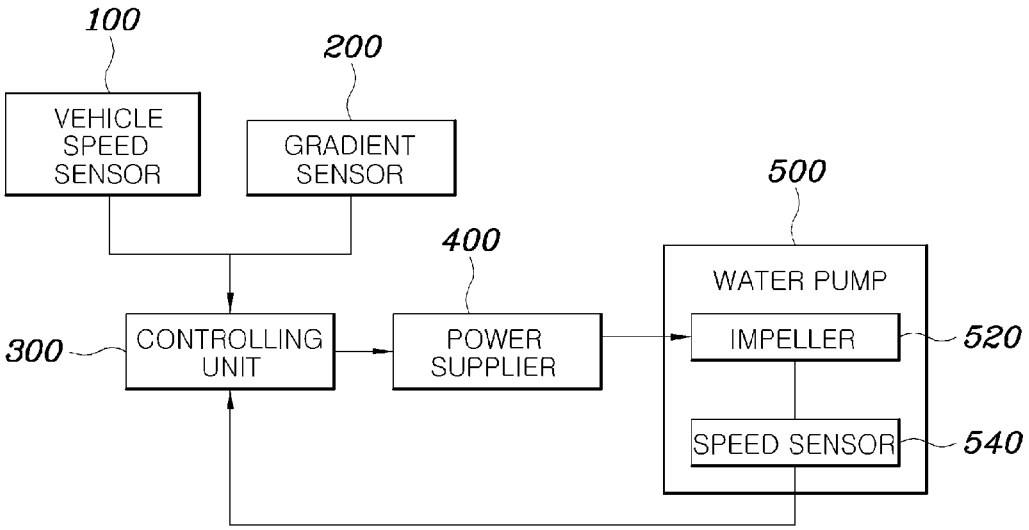
FIG. 1 is a configuration diagram of a system for diagnosing insufficiency of vehicle coolant according to an exemplary embodiment of the present disclosure.

Hereinafter, a method and a system for diagnosing insufficiency of vehicle coolant according to an exemplary embodiment of the present disclosure will be described with reference to the accompanying drawings.

The system for diagnosing insufficiency of vehicle coolant according to an exemplary embodiment of the present disclosure may be used in a cooling system using an electric water pump.

More specifically, the system for diagnosing insufficiency of vehicle coolant includes a vehicle speed sensor 100, a gradient sensor 200, and a coolant water pump 500 which includes an impeller 520 receiving an output from a power supplier 400 to thereby be rotated. A controller 300 performs a feedback-control on the output from the power supplier 400 to the coolant water pump 500 depending on a coolant temperature at ordinary times, and controls the power supplier 400 to apply a predefined output to the coolant water pump 500 when the vehicle is in a stop state and is on flat ground. The system further measures a rotation speed of the impeller 520, and compares the measured rotation speed with a reference speed to judge whether or not the coolant is insufficient.

FIG. 1 is a configuration diagram of a system for diagnosing insufficiency of vehicle coolant according to an exemplary embodiment of the present disclosure, wherein the vehicle speed sensor 100 and the gradient sensor 200 of the vehicle are first prepared, and perform the diagnosis when the vehicle is in a stop state, and a gradient is flat. Flat ground may be determined by using a G sensor or the like of the vehicle, when an inclined angle is within a predetermined range.

When the vehicle speed is 0, and the gradient is 0, it needs to be determined whether or not there is insufficient coolant for the rotation of the impeller 520. In addition, as regards the coolant amount, factors (disturbance factors) having an effect on the rotation should be considered. In order to remove the effect of the disturbance factors, the impeller condition, the vehicle speed, and the gradient at the time of entering the diagnosis, and a cooperative control performance (a voltage control, or the like) with the respective controllers need to be checked.

The rotation speed of the impeller 520 may be measured by a rotation speed of a motor using a sensor, such as a hall sensor.

Figure 2:
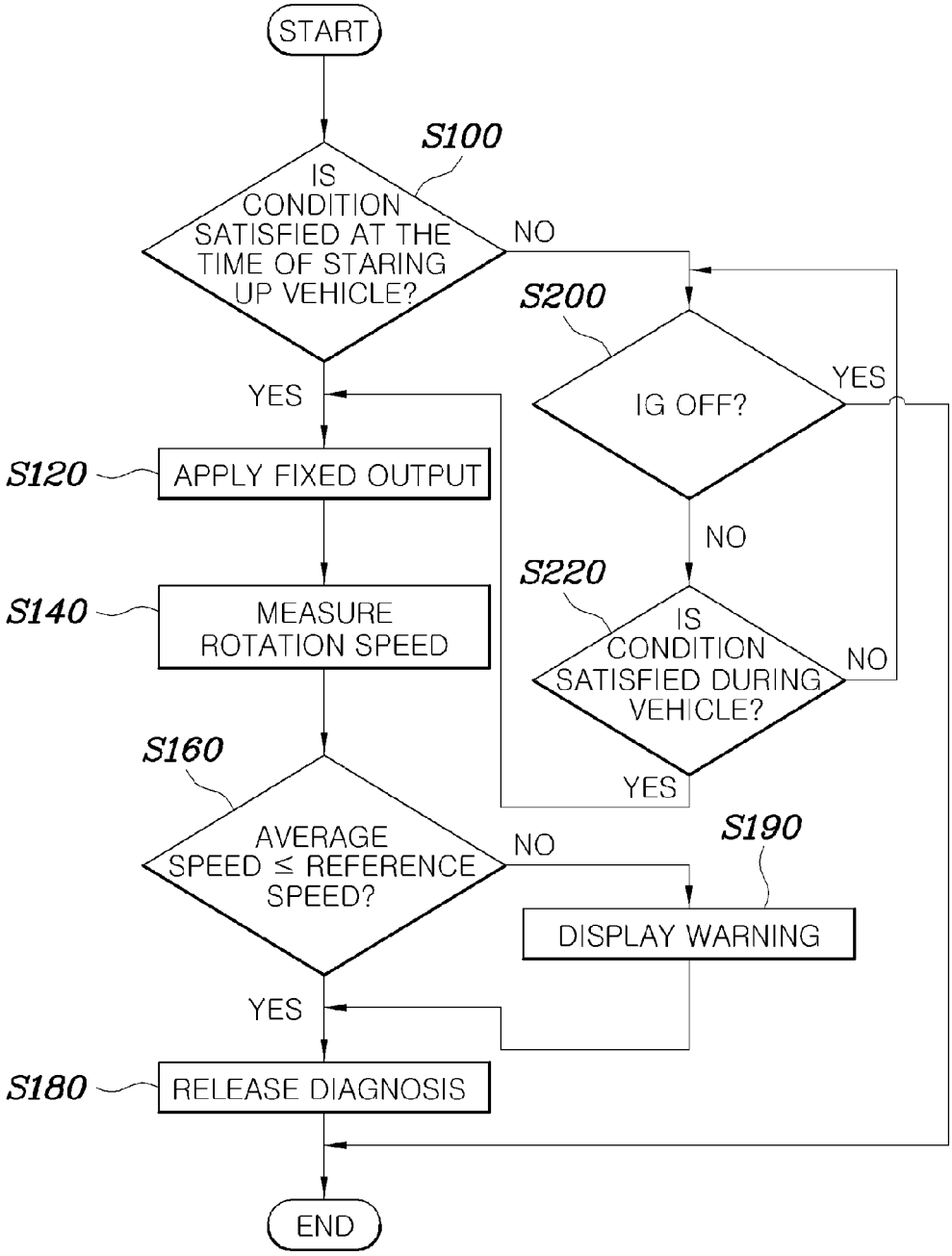
FIG. 2 is a flow chart of a method for diagnosing insufficiency of vehicle coolant according to an exemplary embodiment of the present disclosure.

FIG. 2 is a flow chart of a method for diagnosing insufficiency of vehicle coolant according to an exemplary embodiment of the present disclosure. The method for diagnosing insufficiency of vehicle coolant includes a preparing step (S100) of checking whether the vehicle is in a stop state and is on flat ground. An operating step (S120) applies a predefined output to a coolant water pump when the vehicle is in the stop state and is on the flat ground. A measuring step (S140) measures a rotation speed of a coolant water pump impeller for a period in which the predefined output is applied to the coolant water pump, and a determining step (S160) compares the measured rotation speed of the impeller with a reference speed to determine whether or not the coolant is insufficient.

A coolant insufficiency diagnosis is performed at the time of starting-up the vehicle before the vehicle moves, thereby preventing a problem that may occur due to the insufficiency of the coolant in advance. If a diagnosis entering condition is not satisfied at the time of starting-up the vehicle, the diagnosis does not start, until the entering condition is satisfied. The coolant insufficiency diagnosis performed only once until IG OFF so as not to waste energy of an electric water pump (EWP). The coolant insufficiency diagnosis is not performed at the time of stopping the vehicle before IG OFF if the diagnosis is normally performed at the time of starting-up the vehicle.

In the preparing step (S100), whether the vehicle is in the stop state and is on flat ground is checked, at the time of starting-up the vehicle to check a start-up condition. In the case in which the vehicle is in the stop state and is on flat ground, in the operating step (S120), the predefined output is applied to the coolant water pump. In the operating step, a predefined voltage or current is applied according to a motor control scheme.

The rotation speed of the coolant water pump impeller is measured in the measuring step (S140) for the period in which the predefined output is applied to the coolant water pump, and the determining step (S160) compares the measured rotation speed of the impeller with the reference speed to determine whether or not the coolant is insufficient.

In the case in which the rotation speed of the impeller is smaller than the reference speed, the coolant may be sufficient. However, in the case in which the rotation speed of the impeller is larger than the reference speed, the coolant may be insufficient, therefore a load applied to the motor may be as small as the coolant. In the case in which the rotation speed of the impeller is larger than the reference speed, a warning is displayed (S190). The warning may be displayed in a cluster or the like.

The rotation speed generated at the time of applying the predefined output with normal coolant amount is measured in advance through an experiment and then mapped to the reference speed.

As described above, diagnosing whether or not the coolant is insufficient is performed by measuring the rotation speed of the impeller when the coolant is insufficient. The coolant water pump is subjected to a speed feedback control (closed loop control) of constantly controlling the rotation speed in order to continuously circulate the coolant at a constant speed and is subjected to an open loop control in order to perform the diagnosis through a change in the rotation speed at the time of the diagnosis.

The smaller the coolant amount, the smaller the load applied to the rotation of the coolant water pump. Therefore, the smaller the coolant amount, the smaller the load and the faster the rotation speed of the coolant water pump for the open loop control. The rotation speed when the coolant amount is insufficient is detected and compared with the reference speed to perform the coolant insufficiency diagnosis.

In order to determine whether or not the coolant amount is insufficient through the rotation speed of the impeller, a relationship between the rotation speed and the coolant amount needs to be reliable. Therefore, as described above, in addition to the coolant amount, factors (disturbance factors) having an effect on the rotation speed are considered.

In the preparing step (S100), in the case in which the vehicle is in a start-up state, it is checked whether the vehicle speed is 0 and is on flat ground.

Further, in the preparing step (S100), in the case in which the vehicle speed is neither 0 nor the vehicle is on flat ground when the vehicle is in the start-up state, it is checked whether the vehicle is again stopped when driving and is on flat ground (S200 and S220). That is, if the checking fails at the time of starting up the vehicle, the checking is performed again in a stop state of the vehicle when operating the vehicle.

In the operating step (S120), when the vehicle is again stopped when being driven and is on flat ground, the predefined output is applied to the coolant water pump after a first reference time elapses in the stop state of the vehicle to perform the checking.

The determining step (S160), in the case in which the measured rotation speed of the impeller is greater than the reference speed, determines that the coolant is insufficient.

More specifically, the predefined output is applied to the coolant water pump for a second reference time in the operating step (S120), and in the determining step (S160), determines whether or not the coolant is insufficient by averaging the rotation speeds of the impeller measured for the second reference time and comparing the average value with the reference speed, thereby further increasing reliability of measurement.

The present disclosure described above has the following control features.

1. Dualize a water pump speed control to fix an applied output to a predefined value at the time of a diagnosis, and adjust the applied output in order to maintain the constant rotation speed through a feedback control at ordinary times.

2. Allocate a water pump diagnosis entering command CAN signal to an upper controller in order to dualize the speed control.

3. Perform the diagnosis at the time of starting-up the vehicle and stopping the vehicle when driving the vehicle, respectively, in consideration of a change in the rotation speed of the impeller depending on a driving condition regarding water pump disturbance factors. At the time of stopping the vehicle when driving the vehicle, the coolant transfers into a coolant reservoir tank due to a the vehicle being driven, such that In/Out passages of the coolant reservoir tank are exposed to generate air inflow or the like. Therefore, the coolant impeller generates a variation on the rotation speed of the impeller.

4. Confirm a speed of 0 and enter the diagnosis in consideration of a phenomenon that the coolant is inclined and undulates at the time of driving the vehicle having water pump disturbance factors.

5. Refer to the rotation speed after a predetermined time elapses once the vehicle has stopped when driving, such that less coolant is transferred, in consideration of the water pump disturbance factors.

6. Enter the diagnosis by confirming the gradient, whether the vehicle is on flat ground in consideration of the coolant being inclined and the water pump disturbance factors.

7. Enter the diagnosis after fixing a control power output from a power supplier such as a converter or the like, which is an input voltage of the coolant water pump, in consideration of a change in the rotation speed due to a current variation caused by an input voltage variation because of the water pump disturbance factors (The input voltage of the coolant water pump corresponds to an output voltage of the converter, similar to other controllers). The output voltage of the converter may be varied depending on the use of a vehicle load. Command a predefined control so as to prevent a variation in the output voltage at the time of the coolant insufficiency diagnosis.

8. Calculate an average rotation speed for the diagnosis in order to increase reliability.

9. Perform the coolant insufficiency diagnosis only once until IG OFF so as not to waste energy caused by frequent driving of the coolant water pump.

Figure 3:
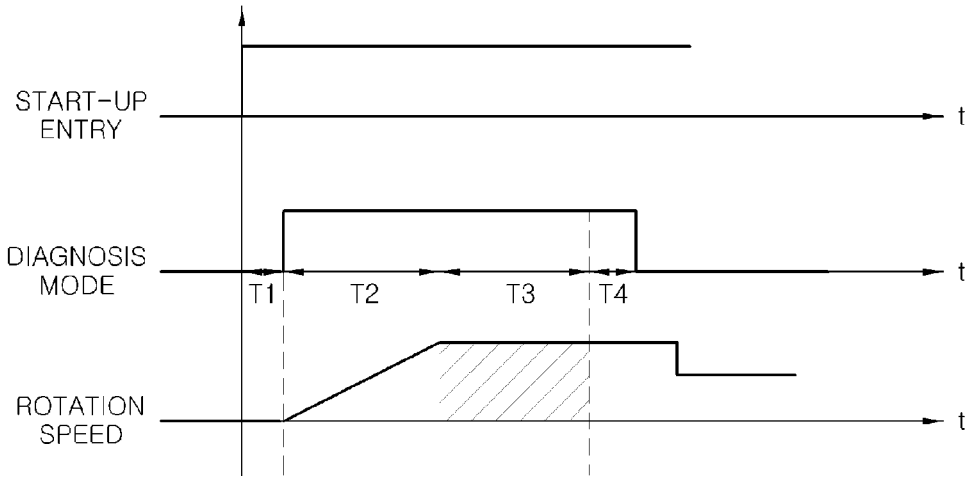
FIGS. 3 and 4 are graphs showing a change in a rotation speed of an impeller depending on the method for diagnosing insufficiency of vehicle coolant according to an exemplary embodiment of the present disclosure.
Figure 4:
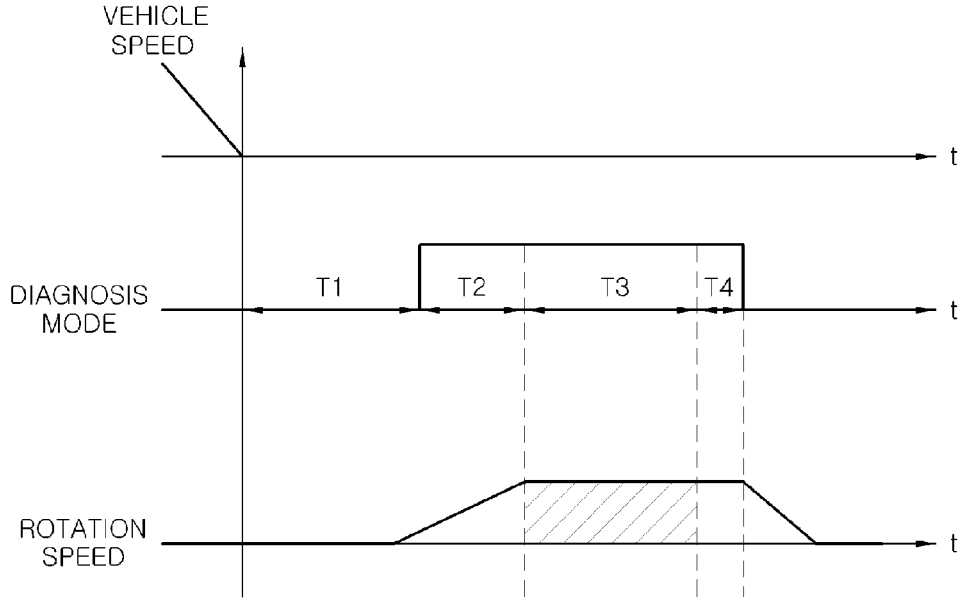

FIGS. 3 and 4 are graphs showing a change in a rotation speed of an impeller depending on the method for diagnosing insufficiency of a coolant of a vehicle according to an exemplary embodiment of the present disclosure, wherein FIG. 3 shows a diagnosis at the time of starting-up the vehicle. After checking a vehicle speed and a gradient for a time of T1 at the time of starting-up the vehicle, a diagnosis mode starts. Then, the predefined output is applied to the coolant water pump, and the rotation speeds of the impeller are measured for a time of T3 after a stabilization time of T2 elapses. An average of the rotation speeds is calculated. After the diagnosis, an automatic control drives the coolant water pump.

FIG. 4 shows a diagnosis at the time of stopping when driving the vehicle. In this case, there is a large allocation of time for T1 allowing a certain period of time to pass after stopping the vehicle in order to stabilize movement of the coolant in the reservoir.

In an exemplary embodiment of the present disclosure, a hybrid vehicle or the like uses an electric water pump (EWP) in order to cool power electronics (PE) components. The EWP does not operate at ordinary times. However, when a temperature of a power converter component rises to a predetermined level or higher, the EWP performs a speed feedback control (closed loop control) to circulate the coolant at a predetermined speed.

When the coolant is evaporated or leaked, a coolant insufficiency diagnosis is performed at the time of starting-up the vehicle in order to inform a driver before driving to reduce risk. Diagnosis entering conditions, such as the vehicle speed of 0 kph, the gradient of 0, and the EWP being in a normal state, are confirmed immediately after starting-up the vehicle. If the diagnosis entering conditions are satisfied, an upper controller commands the EWP that performs the speed feedback control (closed loop control) to perform a fixed current duty control (fixed duty control: open loop control) and start a cooperative control with other necessary controllers at the time of the diagnosis.

The upper controller calculates an average value of rotation speeds after a predetermined time has passed in consideration of a time increase in the rotation speed of an impeller of the EWP. The average value is compared with a reference speed value, which becomes a reference value for determining whether or not the coolant is insufficient, at the time of starting-up the vehicle, to perform the coolant insufficiency diagnosis. After performing the coolant insufficiency diagnosis, the upper controller commands the EWP to perform the speed feedback control and stops the cooperative control with other controllers.

However, if the diagnosis entering conditions are not satisfied at the time of stopping the vehicle when driving the vehicle, for example a minimum time required for the diagnosis is not satisfied due to a quick start when starting-up the vehicle, or the vehicle is parked on inclined ground allowing the coolant to be inclined toward one side, such that a load of the coolant is changed to have an effect on the rotation speed, the diagnosis repeats until the conditions are satisfied. After the diagnosis entering conditions similar to the diagnosis entering conditions at the time of starting the vehicle are confirmed, and a predetermined time in which the coolant that has been shaken when driving the vehicle is stabilized additionally elapses, the diagnosis starts. The diagnosis uses the same method used at the time of starting-up the vehicle. A coolant amount is compared, which becomes a reference value for determining the insufficiency, at the time of stopping the vehicle when driving the vehicle to perform the coolant insufficiency diagnosis. The upper controller commands the EWP to perform the speed feedback control and stops the cooperative control with other controllers.

According to the method and the system for diagnosing insufficiency of a coolant of a vehicle, a power converter cooling system unlike the related art is logically implemented, thereby reducing the installation cost of a temperature sensor.

In addition, the entire power converter cooling system is used, and disturbance factors that may occur in the vehicle and may deteriorate the cooling system are reflected in the logic, thus increasing reliability of the diagnosis.

Although the present disclosure has been shown and described with respect to specific exemplary embodiments, it will be obvious to those skilled in the art that the present disclosure may be variously modified and altered without departing from the spirit and scope of the present disclosure as defined by the following claims.

What is claimed is:

1. A method for diagnosing insufficiency of a vehicle coolant, comprising:

a preparing step of checking whether the vehicle is in a stop state and is on flat ground;

an operating step of applying a predefined output to a coolant water pump when the vehicle is in the stop state and is on the flat ground;

a measuring step of measuring a rotation speed of an impeller of the coolant water pump for a period in which the predefined output is applied to the coolant water pump; and a determining step of comparing the measured rotation speed of the impeller of the coolant water pump with a reference speed to determine whether or not the coolant is insufficient, wherein in the operating step, the predefined output is applied to the coolant water pump for a first reference time, and in the determining step, rotation speeds of the impeller of the coolant water pump measured for the first reference time are averaged, and the average value is compared with the reference speed to determine whether or not the coolant is insufficient.

2. The method of claim 1, wherein in the preparing step, it is further checked whether a vehicle speed is 0 and the vehicle is on the flat ground when the vehicle is in a start-up state.

3. The method of claim 2, wherein in the preparing step, it is further checked whether the vehicle is again stopped when being driven and is on the flat ground, in the case in which the vehicle speed is neither 0 nor is on the flat ground when the vehicle is in the start-up state.

4. The method of claim 3 is applied, wherein in the operating step, the predefined output is applied to the coolant water pump after a second reference time elapses in the stop state of the vehicle when the vehicle is again stopped when being driven and is on the flat ground.

5. The method of claim 1, wherein in the determining step, whether the coolant is insufficient is determined in the case in which the measured rotation speed of the impeller of the coolant water pump is larger than the reference speed.

6. A system for diagnosing insufficiency of a vehicle coolant comprising:

a vehicle speed sensor;

a gradient sensor;

a coolant water pump including an impeller receiving an output from a power supplier to thereby be rotated; and a controlling unit performing a feedback-control on the output from the power supplier to the coolant water pump depending on a coolant temperature at ordinary times, performing a control so that the power supplier applies a predefined output to the coolant water pump when the vehicle is in a stop state and is on a flat ground, measuring a rotation speed of the impeller of the coolant water pump, and comparing the measured rotation speed with a reference speed to judge whether or not the coolant is insufficient, wherein the predefined output is applied to the coolant water pump for a first reference time, rotation speeds of the impeller of the coolant water pump measured for the first reference time are averaged, and the average value is compared with the reference speed to determine whether or not the coolant is insufficient.

* * * * *